United States Patent [19]

Centanni

[11] 4,177,935

[45] Dec. 11, 1979

[54] LINED BULK CONTAINER AND METHOD OF FORMING SAME

[75] Inventor: Michael J. Centanni, New Orleans, La.

[73] Assignee: The Continental Group, Inc., New York, N.Y.

[21] Appl. No.: 894,542

[22] Filed: Apr. 7, 1978

[51] Int. Cl.[2] ..... B65D 5/56; B31B 49/02

[52] U.S. Cl. ..... 220/417; 93/36 SQ; 93/36.01; 220/443; 229/23 R; 229/37 R

[58] Field of Search ..... 220/418, 417, 441, 443, 220/416, 453; 229/23 R, 41 B, 37 R; 93/36.01, 36 SQ, 36 M, 36.6

[56] References Cited

U.S. PATENT DOCUMENTS

| | | | |
|---|---|---|---|
| 1,973,930 | 9/1934 | Rammer | 220/441 |
| 2,718,348 | 9/1955 | Montfort | 229/37 R |
| 2,986,078 | 5/1961 | Hottendorf | 93/36 SQ |
| 3,027,060 | 3/1962 | Beder | 229/37 R X |
| 3,281,050 | 10/1966 | Scchodolski | 229/37 R |
| 3,726,467 | 4/1973 | Shepherd | 229/23 R |
| 3,744,702 | 7/1973 | Ellison | 220/415 X |
| 3,829,000 | 8/1974 | Ellison | 220/418 |
| 3,873,017 | 3/1975 | Blatt | 220/443 X |
| 3,979,045 | 9/1976 | Bomburg et al. | 229/23 R |

*Primary Examiner*—Allan N. Shoap
*Attorney, Agent, or Firm*—Charles E. Brown

[57] ABSTRACT

A lined bulk container which is formed from a box blank and a liner blank and wherein the liner blank is folded upon itself to be of double thickness. The liner blank is folded upon itself with two liner portions thereof being adhesively bonded together, after which the folded liner blank is adhesively bonded to the box blank and then the combined blanks are partially folded to form a knocked-down box. The blanks have aligned transverse fold lines facilitating the folding of the blanks to form box body panels. The liner portion which is bonded to the box blank has along the remote fold lines thereof slots which facilitate folding, the length of the slots controlling the square folding of the combined blanks whereby the knocked-down boxes can be manufactured in a continuous flow and without at least the adhesive which bonds the liner blank to the box blank having set.

9 Claims, 4 Drawing Figures

LINED BULK CONTAINER AND METHOD OF FORMING SAME

This invention relates in general to new and useful improvements in container construction, and most specifically to a lined bulk container and the method of forming the same. The container is of a general construction similar to the container disclosed in my copending application Ser. No. 765,423, now U.S. Pat. No. 4,087,041, granted May 2, 1978.

This invention most particularly relates to a bulk container or box which includes a rectangular box having a double wall liner, the box and liner being preferably formed of corrugated board. The liner is formed from a single blank and includes first and second liner portions integrally joined along a longitudinal fold line. The liner portions have aligned transverse fold lines facilitating the folding of the liner to form internal sides of the box. The box is formed from a conventional blank and includes a body portion which is divided into side walls or panels by transverse fold lines, the spacing of which corresponds to the spacing of the fold lines in the liner portions.

In my prior application I disclosed one of the liner portions as having slots along the fold lines thereof to facilitate the folding of the double thickness liner. It has, however, been found that the length of the slots, particularly those which are aligned with remote fold lines, is critical in assuring that a square box is formed.

It is desirable that the box be formed to its knocked-down stage in a continuous flow without delays. On the other hand, it has been found that even if the folded liner blank has the liner portions thereof adhesively bonded together in advance, the folded and bonded liner cannot under normal circumstances then be bonded to the box blank and the assembly of the box blank and folded liner be immediately thereafter folded to the knocked-down box stage without the assembly being held flat to dry.

It has been found that when the folding of the assembly is effected before the adhesive bottom liner and the box blank is set, the folding is not square due to various production inaccuracies, and this causes the box to set up cockeyed. However, it has been found that by varying the length of the slots aligned with the remote fold lines, the inaccuracies can be compensated for and an assembly can be arrived at that will consistently form a box which will set up square.

In accordance with this invention several liner blanks are formed and then are folded along their longitudinal fold lines followed by the adhesive bonding together of the two liner portions, after which the folded liner is immediately adhesively bonded to the box blank followed by the folding of the assembly to form a knocked-down box. The knocked-down box is then permitted to set until the adhesives have dried or set, after which the several formed knocked-down boxes are set up to see if the boxes are square or cockeyed. Depending upon which way the outer panels inaccurately fold, the respective slots are lengthened or decreased and a few other boxes are formed. The inspection process is repeated and the slot lengths varied until the box will set up square. Then a production run of many thousand boxes is made with the assurance that the boxes will set up square notwithstanding the knocked-down boxes are formed in a continuous flow without permitting the adhesive to dry.

With the above and other objects in view that will hereinafter appear, the nature of the invention will be more clearly understood by reference to the following detailed description, the appended claims, and the several views illustrated in the accompanying drawings.

IN THE DRAWINGS

Figure 1:
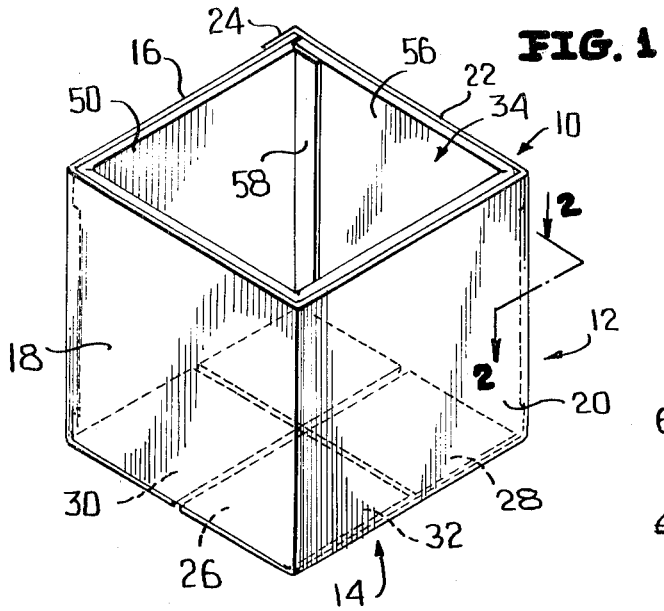
FIG. 1 is a perspective view of the box formed in accordance with this invention in its set up state.

Referring now to the drawings in detail, it will be seen that there is illustrated in FIG. 1 a container or box which is formed in accordance with this invention, the box being generally identified by the numeral 10. The box 10 is generally rectangular in outline and includes a body 12 and a bottom 14. The body 12 is formed of side panels 16, 18, 20 and 22 with the side panel 22 having a closure flap 24 which is suitably bonded to the exteriorly adjacent portion of the side panel 16.

The bottom 14 is formed of a plurality of closure flaps including inner closure flaps 26 and 28 which are hingedly connected to the side panels 18 and 24, respectively. The bottom 14 also includes inner closure flaps 30 and 32 which underlie the closure flaps 26, 28 and are hingedly connected to the lower edges of the side panels 16 and 20, respectively. The closure flaps may be secured together in any desired manner.

The box 10 is also provided with a double walled liner, generally identified by the numeral 34. The liner is adhesively bonded to the inner surface of the side panels of the box and greatly strengthen the box.

The box 10 is primarily intended to be utilized as a bulk carrier, although it may be utilized for other products, and is provided with a removable cover (not shown).

The box 10 is made and sold in a knocked-down state with the bottom forming flaps unsecured to one another. The box is shipped in its knocked-down state and is erected by the ultimate user. The box is most expeditiously formed by first forming the double walled liner 34, then applying the liner to the box blank, and then while the adhesive bonding the liner to the box blank is still unset, folding the assembly of the box and liner so as to bring the remote ends of the assembly together. As set forth above, it has been found in the past that if one attempts to do this in a continuous flow, there is a displacement of the liner relative to the box blank and the box blank does not fold properly.

In accordance with this invention, the liner 34 is formed in a manner similar to that described in my U.S. Pat. No. 4,087,041, but is slightly modified therefrom. The liner 34 is formed from a blank generally identified by the numeral 36. The blank 36 is generally rectangular in outline and is divided into two liner portions by a longitudinal fold line 38. The resultant liner portions 40 and 42 are divided by transverse fold lines. These include fold lines 44, 46 and 48 in the liner portion 40 setting off liner panels 50, 52, 54 and 56, respectively. A closing flap 58 is hingedly connected to the liner panel 56 by a further fold line 60.

The liner portion 42 is divided into similar panels 62, 64, 66 and 68 by further fold lines 70, 72 and 74 which are in alignment with and continuations of the fold lines 44, 46 and 48, respectively. The fold lines 70, 74 are interrupted by elongated slots 76, 78 which constitute a primary feature of this invention.

Figure 2:
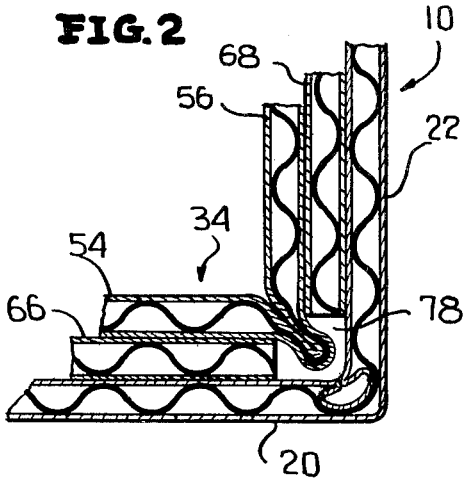
FIG. 2 is an enlarged fragmentary sectional view taken through one corner of the box along the line 2—2 of FIG. 1, and shows the general constructional details of the box.

Referring now to FIG. 2, there is illustrated a typical corner construction which includes the box side panels 20, 22, outer liner panels 66, 68 and inner liner panels 54, 56. It will be seen that when the assembly of the box 10 and the liner 34 is folded, due to the fact that the box and liner are formed of relatively thick material, such as corrugated board, the corner portion between the panels 54, 56 is crushed, and due to the provision of the slot 78 it may extrude or extend into the slot between the liner panels 66, 68.

Figure 3:
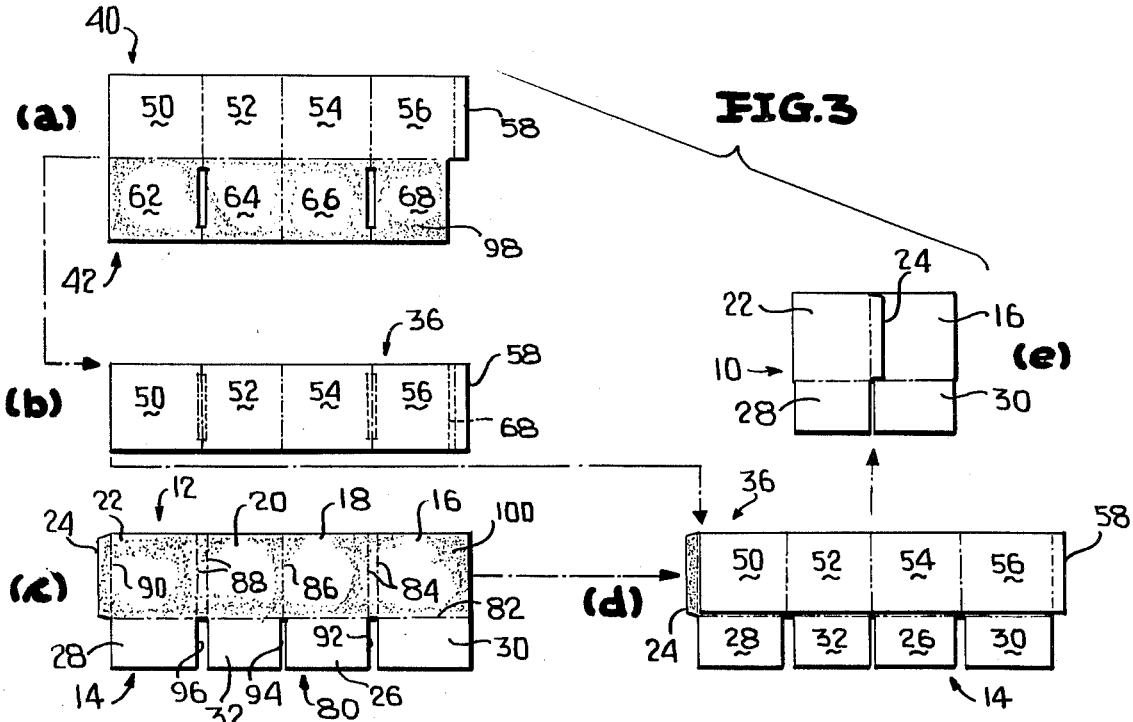
FIG. 3 is a flow diagram schematically showing how the liner blank is first folded and then assembled with the box blank, after which the assembly is folded to form the knocked-down box.
Figure 4:
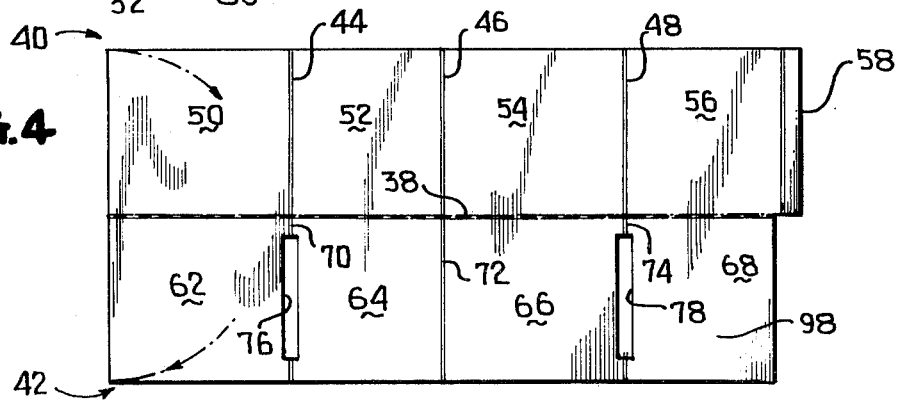
FIG. 4 is an enlarged plan view of the liner.

Reference is now made to FIG. 3*c* wherein the general details of a blank 80 from which the box 10 is formed are illustrated. The blank 80 is divided into the body 12 and the bottom 14 by a longitudinal fold line 82. The body portion of the blank 80 is divided into the side panels 16, 18, 20 and 22 by transverse fold lines 84, 86 and 88, respectively. The closure flap 24 is joined to the side panel 22 by a fold line 90.

The bottom closure flaps 26, 28, 30 and 32 are defined by slots which extend entirely across the bottom portion of the blank 80. The flaps 30, 26 are separated by a wide slot 92 aligned with the fold lines 84; the flaps 26, 32 are separated by a narrow slot 94 aligned with the fold line 86; and the flaps 32, 28 are separated by a wide slot 96 which is aligned with the fold lines 88.

It is to be understood that the knocked-down box is to be formed in a continuous run utilizing conventional box forming machinery. First, the liner blank 36 has adhesive 98 applied to one of the liner portions 40, 42 and the liner blank is then folded upon itself along the fold line 38 to its double thickness arrangement of FIG. 3*b*. The folded liner blank 36 is now ready for immediate application to a box blank 80. Either the liner blank 36 or the box blank is provided with a suitable adhesive 100 so as adhesively to bond the two together. The liner blank is then applied to the box blank as shown in FIG. 3*d*. Immediately thereafter, the assembly of the box blank and the liner blank is folded along the remote transverse fold lines which in this instance is along the fold lines 84, 44 and 70; and the fold lines 88, 48 and 74, the three fold lines in each set being aligned with one another. The closure flap 58 of the liner blank and the closure flap 24 of the box may now be adhesively bonded to their respective panels, or this bonding may be reserved for another time.

It has been found that even if the liner 34 is preformed with the adhesive 98 which bonds the liner blank portions 40, 42 together has been cut, if one attempts to fold the box blank and liner blank assembly as shown in FIG. 3*e* prior to the setting of the adhesive 100, the assembly will not properly fold along its respective fold lines so that when the resultant box 10 is set up it will be cockeyed or not square. It has been found that if one provides the slots 76, 78 the box and liner assembly will more readily fold, but still it will not necessarily fold squarely when the adhesive 100 is not set. On the other hand, if the adhesive 100 is set, the slots 76, 78 are not essential as is evidenced by the absence of a slot along the fold line 72.

It has been found that by selectively varying the lengths of the slots 76, 78 square folding of the box and liner assembly can be effected when the adhesive 100 has not fully set and even when the adhesive 98 has not fully set. It has been found that if a respective one of the slots 76, 78 is too long, the combined panels folded along the fold lines will kick in one direction, and if the slot is too short the panels will kick in the opposite direction.

It has been found by experience that the slots 76, 78 can be made fairly close to the required length, but there is no formula by which the length of the slots 76, 78 may be determined. This is because, among other things, there most likely will not be perfect alignment of all of the folds of the box blank and liner blank, and therefore different difficulties arise from box to box design.

In accordance with this invention, when a new box is to be made, the slots 76, 78 are made of a length judged to be proper from past experience, and then a short run of boxes is made. For example, only five boxes may be made, but these boxes are made automatically in a continuous flow and are folded to the knocked-down stage of FIG. 3*e* while the adhesives 98 and 100 are unset. Then, after the adhesives have set, the box is set up and the kicking of the various panels out of square is noted and the length of the slots 76, 78 corrected by either lengthening or shortening being indicated by the direction of kick of the panels. An additional small number of boxes is made with the slightly modified liner blanks, and the same process followed to determine whether the change in slot length has corrected the cockeyed set up of the box. This procedure is repeated until square boxes are assured, after which the desired production run is made. It is to be understood that in the past to the knowledge of applicant no one has been able to make a box of the type illustrated in the drawings on a continuous run basis, and that at least prior to the folding steps shown in FIG. 3*e*, the adhesives 98 and 100 have to have set. This time delay is material when hundreds of thousands of a box are to be run.

Referring once again to the drawings, although no slot is provided along the fold lines 72, it is to be understood that if desired a similar slot may be employed, although it is not necessary. It is also printed out here that while the term fold line has been loosely used hereinabove, it is to be understood that the fold lines would normally be formed by scoring, and where folding is difficult there may be two scores defining each fold line such as shown with fold lines 84, 86.

It is also feasible that certain of the fold lines of the liner blank be of the cut and score type.

Although the illustrated box has no top flaps, suitable top flaps may be provided.

Although the invention has been specifically illustrated and described with respect to a box or container suitable for knock-down usage as a bulk carrier, it is to be understood that the invention is not so limited and various modifications may be made without departing from the spirit and scope of the invention as defined by the appended claims.

I claim:

1. A method of forming a knocked-down double lined box, said method comprising in a continuous flow providing a liner blank including first and second liner portions joined along a longitudinal fold line and wherein the first and second liner portions are divided into panels by longitudinally spaced transverse fold lines aligned in the two liner portions, there being formed slots along at least two of the furthest longitudinally remote ones of said longitudinally spaced transverse fold lines of said second liner portion, folding said liner blank along the longitudinal fold and adhesively bonding together the two liner portions, providing a flat box blank having a body portion with transverse fold lines of the same general longitudinal spacing as in the liner portions, positioning the folded and bonded liner blank relative to the box blank body portion and bonding the one of the liner portions to the box blank body portion, and then folding the assembled box blank and liner blank as a unit along the two longitudinally remote transverse fold lines to form the knocked-down double lined box.

2. The method of claim 1 wherein the second liner portion is that liner portion bonded to the box blank.

3. The method of claim 1 wherein the folding of the assembled box blank and liner blank is effected before the adhesive bonding the liner blank to the box blank has set.

4. The method of claim 3 wherein the folding of the assembled box blank and liner blank is effected before the adhesive bonding the liner blank portions together has set.

5. The method of claim 1 together with the steps of inspecting the squareness of the folding of the assembled box blank and liner blank in several initially run boxes, and in the case of an inaccuracy changing the length of the respective slot to provide a modified liner blank, forming additional boxes with the modified liner blank, repeating the inspection steps, and further changing the slot length where necessary to obtain a square folding.

6. The method of claim 5 together with the step of making of a production run of the boxes.

7. A knocked-down liner box, said box comprising a generally rectangular box blank including an elongated body portion divided into a plurality of panels by longitudinally spaced transverse fold lines, a generally rectangular liner blank including first and second elongated liner portions integrally joined along a longitudinal fold line and disposed in relative overlying relation, said first and second liner portions being adhesively bonded together, said liner portions having aligned transverse fold lines longitudinally spaced in accordance with the longitudinal spacing of said box blank fold lines, said second liner portion being adhesively bonded to said box blank body portion, said transverse fold lines including at least two of which are longitudinally remote transverse fold lines remote from the center of said liner blank defining outer panels and other fold lines defining inner panels, the assembled box blank and liner blank outer panels being folded into relatively overlying relation with respect to said inner panels of said box blank and liner panels, said second liner portions having transverse slots along said longitudinally remote transverse fold lines receiving aligned material of said folded first liner portion, said slots being of a selected length which assures square folding of said outer panels relative to said inner panels, said slots each forming a portion of a respective longitudinally remote transverse fold line and having opposite ends terminating remote from an adjacent end of a respective longitudinally remote transverse fold line.

8. The box of claim 7 wherein the adhesive between said second liner portion and said box body portion is not fully set.

9. The box of claim 8 wherein the adhesive between said liner portions is not fully set.

* * * * *